US005838098A

United States Patent [19]

Takagishi

[11] Patent Number: 5,838,098

[45] Date of Patent: Nov. 17, 1998

[54] DEFLECTING APPARATUS WITH ONE PIECE CORE AND ONE PIECE COIL BOBBIN

[75] Inventor: Toshiya Takagishi, Kanagawa, Japan

[73] Assignee: Sony Corporation, Japan

[21] Appl. No.: 679,794

[22] Filed: Jul. 15, 1996

[51] Int. Cl.[6] ..... H01F 7/00

[52] U.S. Cl. ..... 313/440; 315/368.26; 315/370; 335/210; 335/213

[58] Field of Search ..... 315/368.26, 370; 318/370; 335/210, 213; 313/440

[56] References Cited

U.S. PATENT DOCUMENTS

| | | | |
|---|---|---|---|
| 3,569,881 | 3/1971 | Torsch | 335/210 |
| 3,835,426 | 9/1974 | Torsch | 335/210 |
| 4,175,261 | 11/1979 | Sawada | 335/210 |
| 4,376,924 | 3/1983 | Gross et al. | 335/210 |
| 4,712,080 | 12/1987 | Katou | 335/213 |
| 5,039,922 | 8/1991 | Ogasa et al. | 315/370 |
| 5,177,412 | 1/1993 | Morohashi et al. | 318/370 |
| 5,274,308 | 12/1993 | Park et al. | 315/368.26 |

*Primary Examiner*—Sandra L. O'Shea
*Assistant Examiner*—Matthew J. Gerike
*Attorney, Agent, or Firm*—Ronald P. Kananen

[57] ABSTRACT

A deflecting apparatus capable of reducing assembling man-hour and improving deflection efficiency is provided. A coil bobbin 12 has an inner peripheral surface on which horizontal deflection coils are wound and includes a bobbin body 15 and a rear bend member 17 attachable to the rear side of the bobbin body 15, a bell-shaped core 22 having a one-piece structure is fitted on the outer peripheral surface of the bobbin body 15 in close contact therewith, and the rear bend member 17 is firmly attached to the bobbin body 15.

5 Claims, 6 Drawing Sheets

DEFLECTING APPARATUS WITH ONE PIECE CORE AND ONE PIECE COIL BOBBIN

BACKGROUND OF THE INVENTION

1. Field of the Invention

This invention relates to a deflecting apparatus suitable for use in a deflection system for a large-sized television set with a large screen size, a next-generation television set or a high definition television set.

2. Description of the Related Art

A deflecting apparatus as shown in FIG. 4 is used in various television receiving sets including not only existing television receiving sets but also next-generation widescreen television sets and high definition television sets.

In the figure, reference numeral 1 denotes a color cathode-ray tube (hereinafter referred to as "CRT") for displaying color video. An electron gun 2 is immovably housed inside a neck 1*a* of the CRT 1, and a deflecting apparatus 10 is securely attached to an outer peripheral portion of the CRT 1 between the neck 1*a* and a funnel 1*b*, as seen from the figure.

The deflecting apparatus 10 comprises horizontal deflection means 10A and vertical deflection means 10B, as conventionally known. The horizontal deflection means 10A includes horizontal deflection coils 14 which, in the illustrated example, are wound into saddle form and attached to the inner surface of a bell-shaped coil bobbin 12 shown in FIG. 5.

A bobbin body 15 has a front bend 16 and a rear bend 17 formed integrally on its front and rear portions, respectively, and the saddle-shaped horizontal deflection coils 14 are wound on each of the bends 16 and 17. Thus, the bends 16 and 17 are formed so as to protrude along the circumference in parallel with the fluorescent surface of the CRT. FIG. 6 shows the bobbin 12 with the horizontal deflection coils 14 wound thereon, as viewed from the side of the neck 1*a*.

The vertical deflection means 10B, which is securely attached to the outer peripheral surface of the bobbin body 15, includes a core (hereinafter referred to as "coil core") 22 which is a bell-shaped sintered product having an inner surface matching the contours of the outer peripheral surface of the bobbin 15, as shown in FIG. 7, and vertical deflection coils 24 wound in toroidal form at predetermined positions on the outer peripheral surface of the coil core 22. The form of winding is not limited to toroidal winding and may be saddle-shaped winding.

In view of a variety of applications including not only existing television receiving sets but next-generation television receiving sets (widescreen television sets, high definition television sets, etc.) as well as CRT monitors for OA equipment, there has been a demand for deflecting apparatus which are easy to assemble, capable of deflecting an electron beam with high efficiency and free from deflection distortion.

To meet the requirements with the conventional deflecting apparatus shown in the figures, the coil bobbin 12 mounted to the CRT 1 should desirably have a shape such that, provided the bobbin 12 is cut in parallel with the plane of vertical deflection, the sectional form is completely round, and the coil core 22 should desirably be fitted onto the outer peripheral surface of the coil bobbin 12 in close contact therewith.

In many cases, however, both the coil bobbin 12 and the coil core 22 conventionally employ a two-piece structure, and therefore, the assembling work of putting together bobbin elements and core elements is complicated. Also, the bobbin 12 and the core 22 can often be deformed depending on the force applied to fasten the bobbin elements or the core elements together, making it impossible to achieve distortion-free deflection. Such deformation also lowers the deflection efficiency.

If, on the other hand, unseparate or one-piece structure, not two-piece structure, is employed for each of the coil bobbin 12 and the core 22, the assembling is facilitated and at least the sectional forms of the bobbin and the core become close to their design values, thus eliminating deformation. In the case where one-piece structure is employed, however, the following disadvantages arise:

As seen from FIGS. 5, 7 and 8, a small-diameter portion 22*a* of the coil core 22 with one-piece structure must have an inner diameter at least greater than the outermost diameter of the rear bend 17 (the outer diameter of a brim 31). Where a coil core 22 having a sufficient inner diameter is used, when the core 22 is fitted onto the bobbin body 15, the inner surface of the former cannot be brought into close contact with the outer peripheral surface of the latter, with a result that a considerably large gap exists between the bobbin body 15 and the core 22. Such a gap greatly deteriorates the deflection efficiency, making the deflecting apparatus unsuitable especially for widescreen or next-generation television receiving sets.

OBJECT AND SUMMARY OF THE INVENTION

This invention was created to solve the problems associated with the conventional apparatus, and an object thereof is to provide a deflecting apparatus capable of improving the deflection efficiency, and being easy to assemble.

To achieve the above object, this invention provides a deflecting apparatus comprising: a coil bobbin having an inner peripheral surface on which horizontal deflection coils are wound, the coil bobbin having a bobbin body and a rear bend member attachable to a rear side of the bobbin body; and a bell-shaped core having a one-piece structure and fitted on an outer peripheral surface of the bobbin body in close contact therewith, wherein the rear bend member is firmly attached to the bobbin body.

As shown in FIG. 1, both a coil bobbin 12 and a coil core 22 have an unseparate or one-piece structure. The coil bobbin 12 includes a bobbin body 15 having a front bend 16, and a rear bend member 17 attachable to the bobbin body; therefore, the inner surface of the coil core 22 can be formed such that it can be brought into close contact with the outer peripheral surface of the bobbin body 15. In the case where vertical deflection coils 24 are to be wound in toroidal form, the whole shape of the core is determined so that an entire coil winding surface on which the coils are wound may be in close contact with the outer peripheral surface of the bobbin when the vertical deflection coils 24 are wound directly on the core.

The core 22 with coils wound thereon is fitted onto the outer peripheral surface of the bobbin 12 from the rear side thereof, and while in this state, the rear bend member 17 is screwed into and thus fixed to the bobbin body 15. After the core 22 and the rear bend member 17 are attached in this manner, horizontal deflection coils 14 are automatically wound by means of a coil winder.

This arrangement permits the deflecting apparatus 10 to be mounted to a CRT 1 while maintaining the complete roundness of the bobbin 12 and the core 22 with respect to the CRT 1.

Other objects, features and advantages of the present invention will become apparent in the following specification and accompanying drawings.

DESCRIPTION OF THE PREFERRED EMBODIMENTS

Embodiments according to this invention will be hereinafter described in detail with reference to the drawings, wherein a deflecting apparatus of this invention is applied to a television receiving set mentioned above.

Figure 1:
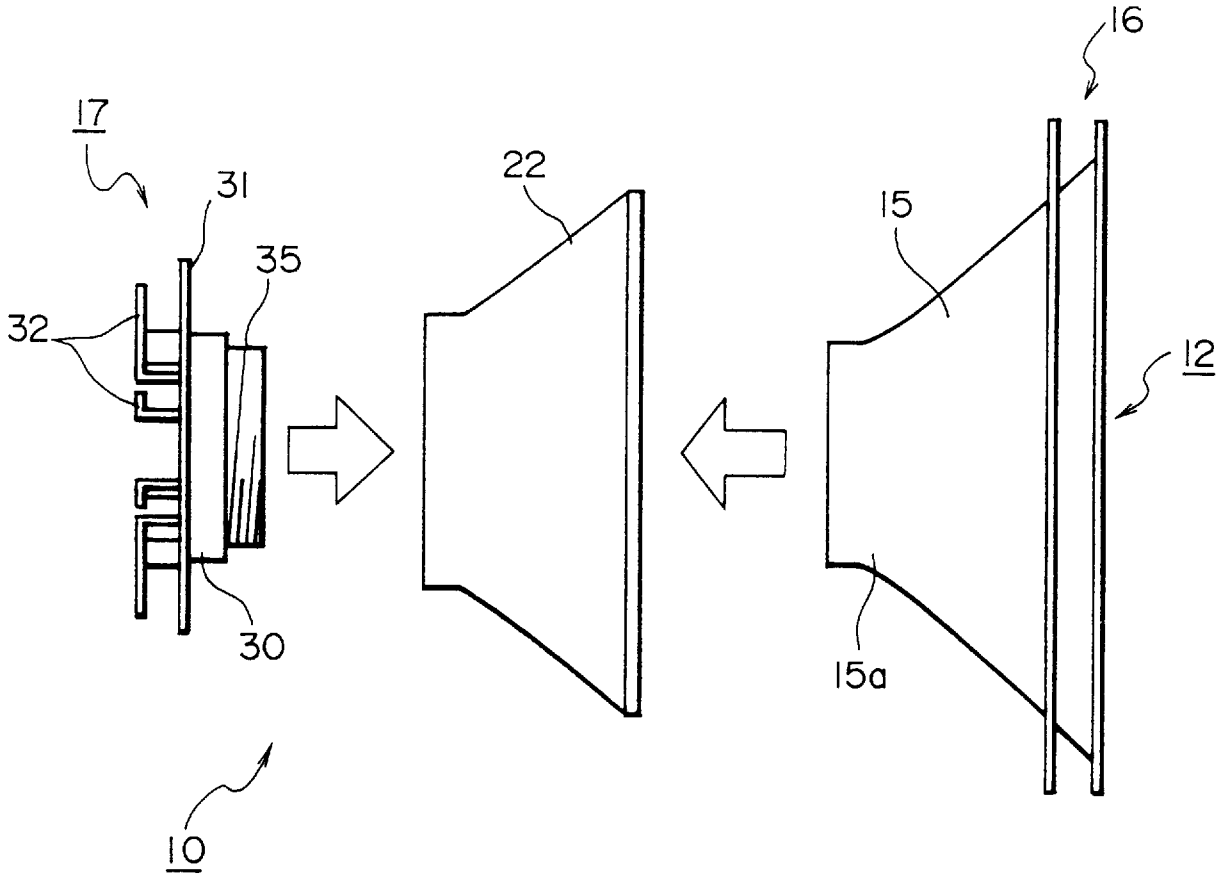
FIG. 1 is an exploded view showing how a deflecting apparatus according to this invention is assembled.

As shown in FIG. 1, a coil bobbin 12 and a coil core 22 used in a deflecting apparatus 10 according to this invention each have an unseparate or one-piece structure.

Because of its one-piece structure, the coil bobbin 12 can be formed into a size such that the inner surface thereof can be brought into close contact with a neck 1*a* and a funnel 1*b* of a CRT 1. This is also the case with the coil core 22; the coil core 22 can be formed into a size such that it can be brought into close contact with the outer peripheral surface of the coil bobbin 12.

In this case, where vertical deflection coils 24 are to be directly wound about the core in toroidal form, the whole shape of the core is selected so that an entire coil winding surface of the core on which the coils are wound can be brought into close contact with the outer peripheral surface of the bobbin.

Figure 4:
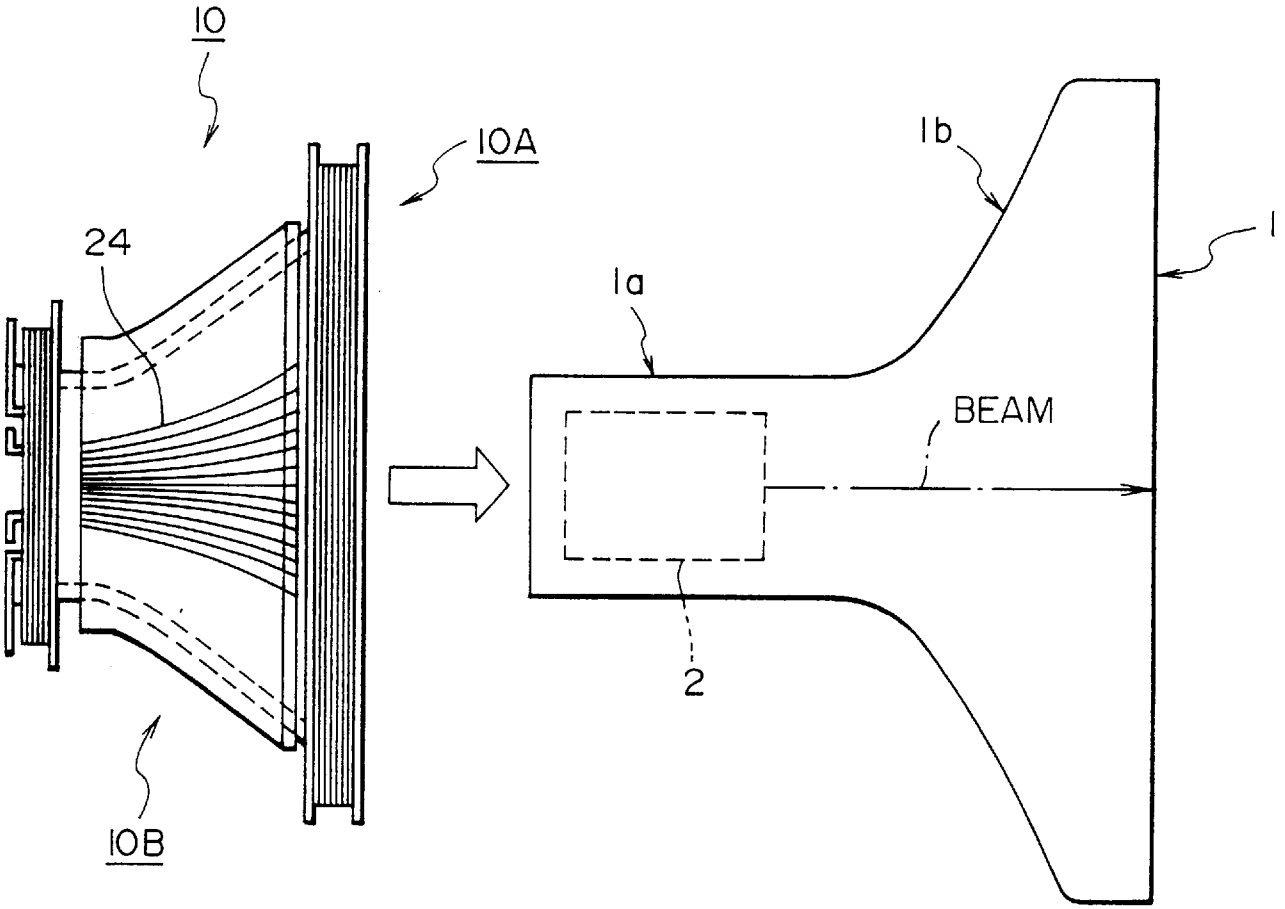
FIG. 4 is a view illustrating a conventional deflecting apparatus.
Figure 5:
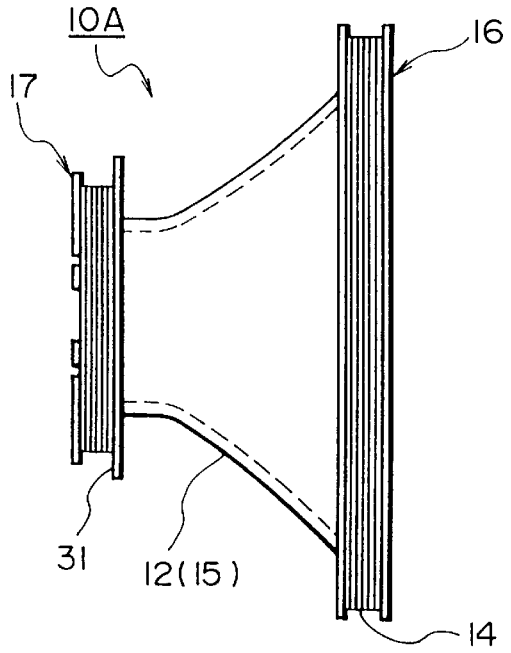
FIG. 5 is a side view of horizontal deflection means using a coil bobbin of one-piece structure.

Consequently, when the deflecting apparatus 10 is assembled as shown in FIG. 4, neither the bobbin 15 nor the core 22 is deformed, thus making it possible to reduce the assembling man-hour and improve the deflection efficiency.

After the core 22 is attached to the coil bobbin 15 as mentioned above, horizontal deflection coils 14 are wound on the bobbin in saddle form. In this case, the coils are wound by using an automatic coil winder. The vertical deflection coils 24 are wound on the coil core 22 in toroidal form also using an automatic coil winder. The form of winding may be saddle-shaped winding using a bobbin, instead of toroidal winding. Whether the coils are to be wound in toroidal form or saddle form is determined in accordance with the purpose for which the CRT is used. With the coils 24 wound on the core 22, the core is fitted onto the bobbin 15.

The coil bobbin 12 comprises a bobbin body 15 having a front bend 16, and a rear bend member 17 which is separate from the bobbin body 15 and can be fitted into the bobbin body.

Figure 6:
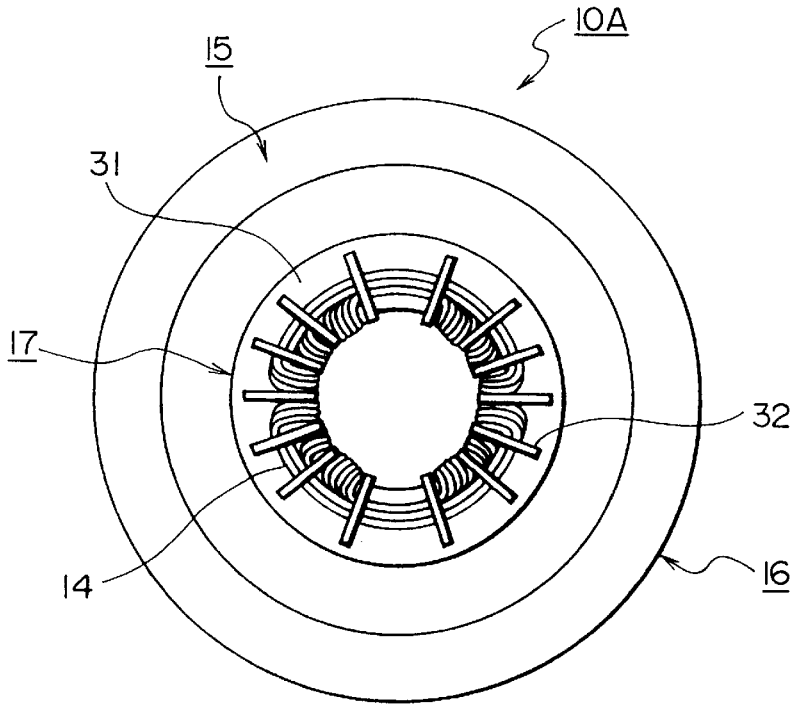
FIG. 6 is a view of the coil bobbin in FIG. 5 as viewed from a neck side.
Figure 7:
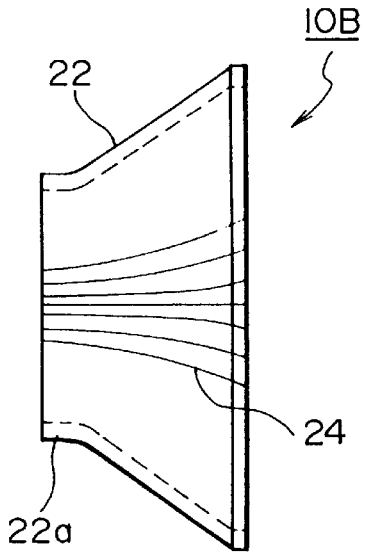
FIG. 7 is a side view of vertical deflection means using a coil core of one-piece structure.
Figure 8:
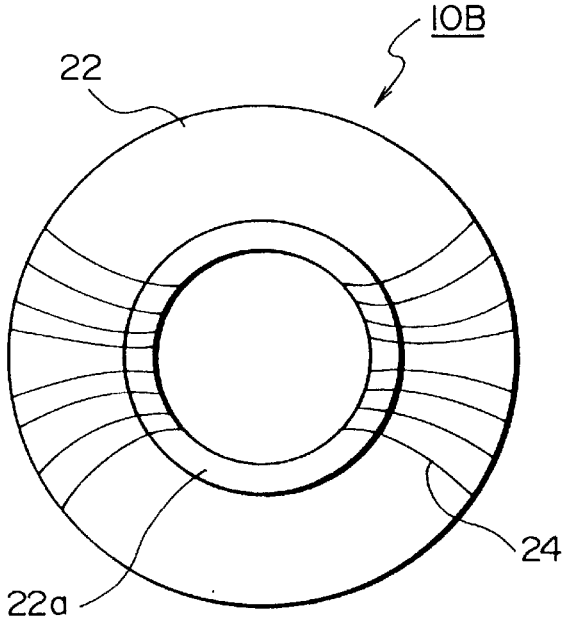
FIG. 8 is a view of the coil core in FIG. 7 as viewed from the neck side.

As shown in FIG. 1, the rear bend member 17 has a cylindrical part 30, an annular brim 31 formed on one side face of the cylindrical part 30, and a plurality of L-shaped hooks 32 formed on the outside of the brim 31 at a predetermined distance therefrom and serving as coil retainers as shown in FIG. 6.

Figure 2:
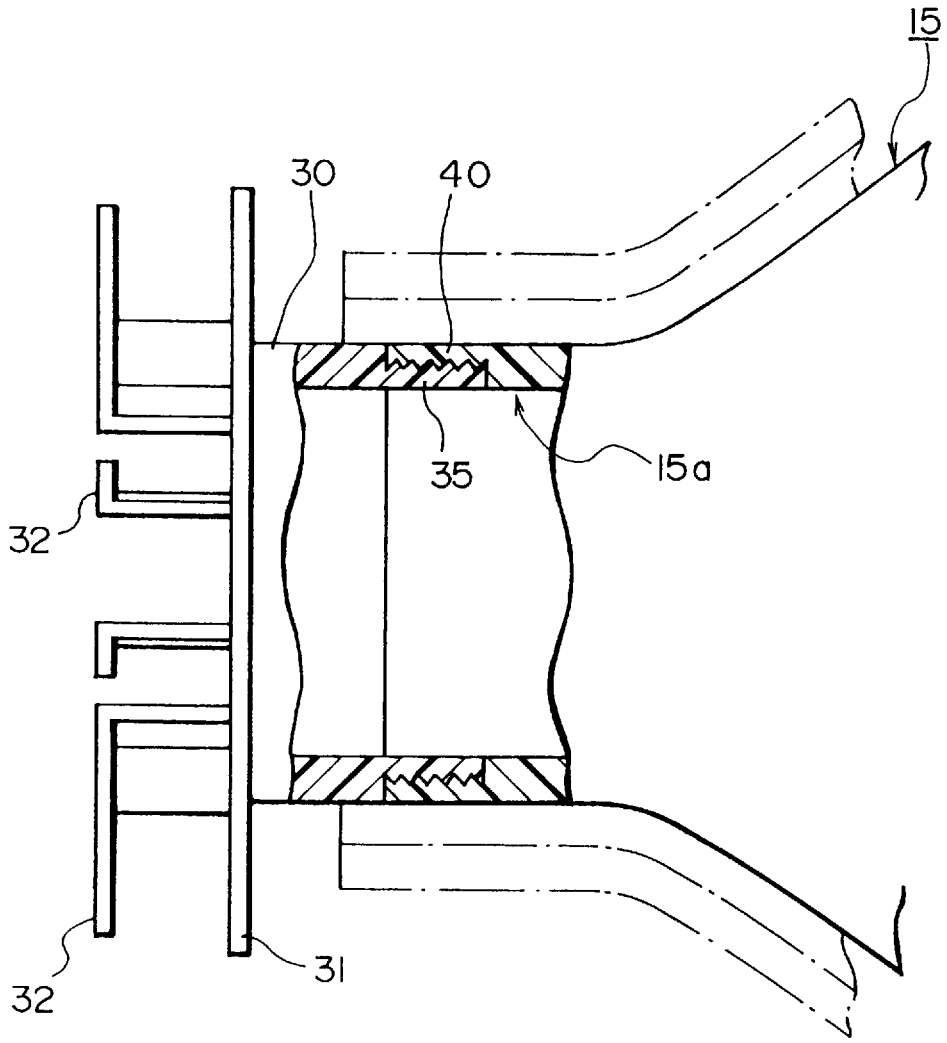
FIG. 2 is a sectional view of a principal part of the assembled apparatus.

The cylindrical part 30 has a thread 35 cut in its front end portion, whereas a rear flat portion 15*a* of the bobbin body 15 also has a threaded portion 40 formed in its inner surface as shown in FIG. 2, and the rear bend member 17 is screwed into the threaded portion 40, whereby the rear bend member 17 and the bobbin body 15 are firmly joined together.

In the case where the rear bend member 17 is screwed into the bobbin body 15 in this manner, these members can sufficiently withstand the stress applied when the horizontal deflection coils 14 are wound, because the rear bend member 17 and the bobbin body 15 are firmly joined together. With this arrangement, it is only necessary that the rear bend member 17 be screwed into the bobbin body, thus facilitating the assembly of the apparatus.

Figure 3:
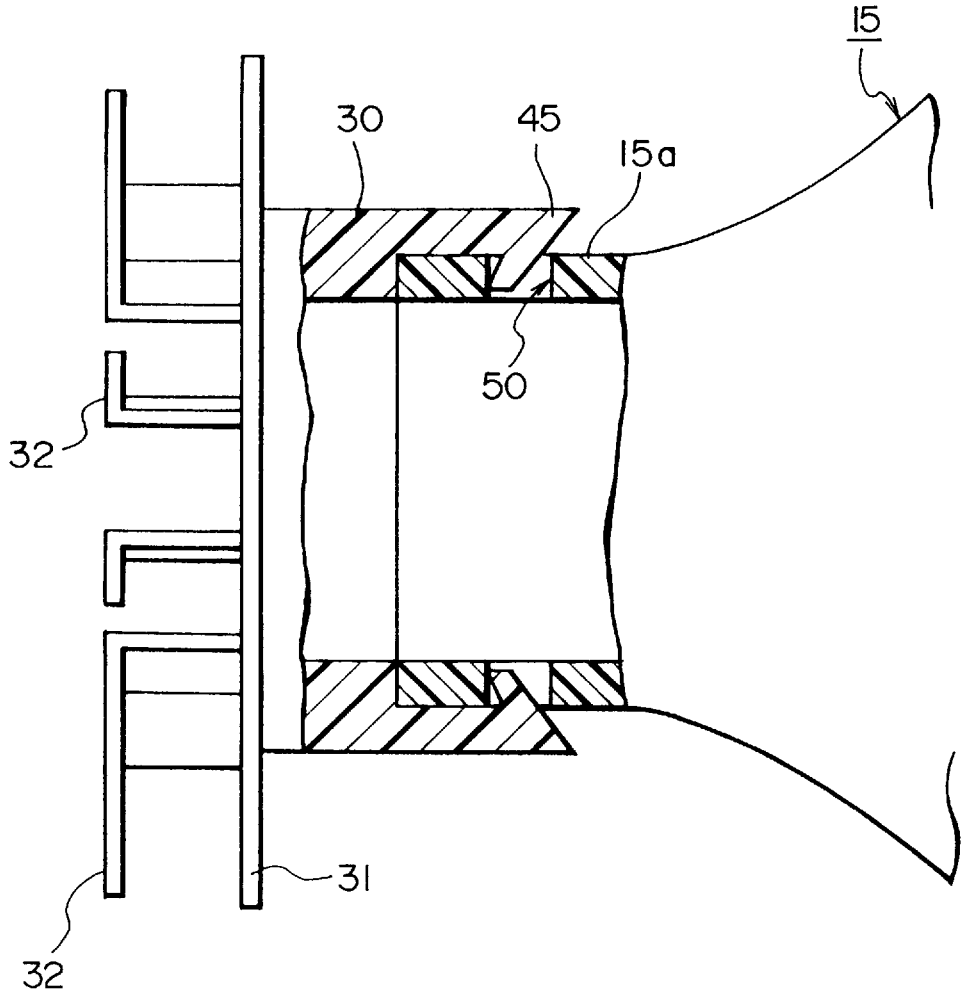
FIG. 3 is a sectional view of a principal part of an assembled apparatus according to another embodiment different from that shown in FIG. 2.

The joining means for attaching the rear bend member 17 to the bobbin body 15 is not limited to the thread connection shown in FIG. 2, and an arrangement shown in FIG. 3 may be employed instead. A cylindrical part 30 shown in FIG. 3 is greater in diameter than the corresponding part shown in FIG. 2, and a pair of engaging claws 45 are formed on a front end portion of the cylindrical part 30. A rear flat portion 15*a* has a pair of engaging holes 50 formed therein at locations corresponding to the respective engaging claws 45.

The pair of engaging claws 45 are located so as to lie on the axis of vertical deflection. This is because the horizontal deflection coils 14 are not wound in the vicinity of the vertical deflection axis and thus the sizes and positions of the engaging claws 45 and the engaging holes 50 can be relatively freely selected without particular restrictions imposed by the horizontal deflection coils 14.

The engaging claws 45 shown in FIG. 3 have short distal end portions, but may have longer distal end portions so as to slightly protrude from the inner surface of the rear flat portion 15*a*. Such arrangement never adversely affects the automatic winding process for the horizontal deflection coils 14 because the horizontal deflection coils 14 are not wound on this region of the inner surface of the rear flat portion.

In the case where the fixing means using engaging claws is employed, the rear bend member 17 and the bobbin body 15 can be firmly joined together by simply inserting the former into the latter, whereby the assembling work can be remarkably simplified and the apparatus can sufficiently withstand the stress applied during the coil winding.

The deflecting apparatus 10 according to this invention is applicable regardless of the screen size of the CRT 1, and thus is suited for use in not only existing television receiving sets with ordinary screen size but also next-generation widescreen or high definition television sets as well as CRT monitors used in OA equipment.

As described above, in the deflecting apparatus according to this invention, the coil bobbin on which the horizontal deflection coils are wound has an unseparate or one-piece structure, instead of separate structure, and the rear bend member is designed so as to be attachable to the bobbin body.

With this arrangement, the unseparate-type core on which the vertical deflection coils are to be wound can be sintered into a shape such that the core can be satisfactorily brought into close contact with the outer periphery of the coil bobbin, and the unseparate structure serves to greatly reduce the assembling man-hour in constructing deflecting apparatus, as compared with conventional arrangement. In addition, since the coil bobbin and the core are not deformed during their fixing operation, the unseparate-type core can be brought into close contact with the bobbin, providing a consequent advantage of improved deflection efficiency.

As many apparently different embodiments of this invention may be made without departing from the spirit and scope thereof, it is to be understood that the invention is not limited to the specific embodiments thereof except as defined in the appended claims.

What is claimed is:

1. A deflecting apparatus comprising:

a coil bobbin having an inner peripheral surface on which horizontal deflection coils are wound, said coil bobbin having a bobbin body and an attachable rear bend member, upon which said coils are partially wound, firmly attached to a rear side of the bobbin body; and a bell shaped core having a one-piece structure, wherein said core is fitted on an outer peripheral surface of the bobbin body.

2. The deflecting apparatus according to claim 1, wherein horizontal deflection coils are wound on said coil bobbin in saddle form, and vertical deflection coils are wound on said one-piece core in toroidal form.

3. The deflecting apparatus according to claim 1, wherein horizontal deflection coils are wound on said coil bobbin in saddle form, and vertical deflection coils are wound on said one-piece core in saddle form.

4. The deflecting apparatus according to claim 1, which comprises a bell-shaped bobbin which has a one-piece structure and on which horizontal deflection coils are wound, and a one-piece core on which vertical deflection coils are wound, said bobbin including a bobbin body having a front bend, and a rear bend member attachable to a rear side of the bobbin body, the rear bend member being screwed and fixed to the bobbin body, and said core having a bell shape such that said core is brought into close contact with the bobbin body.

5. The deflecting apparatus according to claim 1, which comprises a bell-shaped bobbin which has a one-piece structure and on which horizontal deflection coils are wound, and a one-piece core on which vertical deflection coils are wound, said bobbin including a bobbin body having a front bend, and a rear bend member attachable to a rear side of the bobbin body, the rear bend member being fixed to the bobbin body by means of claws formed on the rear bend member and engaging with the bobbin body, and said core having a bell shape such that said core is brought into close contact with the bobbin body.

* * * * *